United States Patent [19]

Montean

[11] Patent Number: 4,746,908

[45] Date of Patent: May 24, 1988

[54] DUAL-STATUS, MAGNETICALLY IMAGABLE ARTICLE SURVEILLANCE MARKER

[75] Inventor: Samuel Montean, Blaine, Minn.

[73] Assignee: Minnesota Mining and Manufacturing Company, St. Paul, Minn.

[21] Appl. No.: 909,467

[22] Filed: Sep. 19, 1986

[51] Int. Cl.[4] ..... G08B 13/24

[52] U.S. Cl. ..... 340/551; 340/572

[58] Field of Search ..... 340/572, 551

[56] References Cited

U.S. PATENT DOCUMENTS

| | | | |
|---|---|---|---|
| 3,665,449 | 5/1972 | Elder et al. | 340/572 |
| 3,747,086 | 7/1973 | Peterson | 340/572 |
| 3,983,552 | 9/1976 | Bakeman, Jr. et al. | 340/572 |

FOREIGN PATENT DOCUMENTS

| | | | |
|---|---|---|---|
| 763681 | 3/1934 | France | 340/572 |

*Primary Examiner*—Glen R. Swann, III

*Attorney, Agent, or Firm*—Donald M. Sell; James A. Smith; William B. Barte

[57] ABSTRACT

A dual status magnetic marker for use in electronic article surveillance systems, in which a piece of low coercive force, high permeability material is positioned adjacent to a piece of remanently magnetizable material. The first piece is configured such that no characteristic response is produced when the magnetization of the entire piece is reversed by an alternating magnetic field in an interrogation zone, and when the second piece is magnetized with a predetermined pattern a localized field is provided which biases portions of the first piece, keeping those portions from reversing when the marker is in the interrogation field. The predetermined pattern is such that the remaining, unbiased portion of the first piece has a configuration capable of producing a characteristic response when the magnetization in that portion is reversed.

42 Claims, 5 Drawing Sheets

DUAL-STATUS, MAGNETICALLY IMAGABLE ARTICLE SURVEILLANCE MARKER

FIELD OF THE INVENTION

This invention relates to electronic article surveillance (EAS) systems of the general type in which an alternating magnetic field is produced in an interrogation zone and in which a magnetically responsive marker present in the zone results in the production of a characteristic signal which is detected and processed to create a suitable response, alarm, etc.

BACKGROUND OF THE INVENTION

Modern magnetically based electronic article surveillance systems generally derive their parentage from 1934 French Patent No. 763,681. That patent depicts the use of markers formed of a piece of low coercive force, high permeability alloy, such as permalloy, and teaches that when the magnetization of such a piece is reversed by a magnetic field alternating at a fundamental frequency, detectable harmonics of that frequency will be produced. More recently, various investigators have developed magnetic markers which have dual-status capabilities. Typically, as disclosed in U.S. Pat. Nos. 3,665,449 (Elder et al.) and 3,747,086 (Peterson), such dual status markers include at least one piece of remanently magnetizable material which when magnetized has associated therewith a magnetic field which biases the low coercive force, high permeability material so as to alter the signal produced when the biased material is in the interrogation field. Systems utilizing such markers are designed so that when the remanently magnetizable material is unmagnetized, the low coercive force material is free to produce certain harmonics on which detection is based. In that state, the marker is then regarded as being sensitized. Alternatively, when the remanently magnetizable material is magnetized, the resultant magnetic bias on the low coercive force piece prevents the formation of the same harmonic response such that the marker is not detected, and the magnetized marker is regarded as being desensitized. Systems operating in such a manner have become quite commercially successful, particularly in circulating libraries and the like for preventing the theft of books. In such installations, a marker is inconspicuously secured within the book to be protected. The magnetizable piece is remotely magnetized in order to allow the book to be checked out and is subsequently demagnetized when the book is checked in. As knowledge of such a procedure has become more commonplace, potential thieves have been known to carry a small permanent magnet in attempts to magnetize, i.e., desensitize the markers to thereby thwart detection as the book is carried through the interrogation zone. The use of such systems may be limited in retail stores and the like where markers may not be concealed within the protected article and are more accessible to such unauthorized desensitization, and where more valuable merchandise warrants a higher degree of protection.

Furthermore, the system disclosed by Elder et al. ('449) utilizes a marker containing a very elongated piece of high permeability material. The reversal of the magnetization in such a piece by an interrogation field alternating at a fundamental frequency results in the production of a characteristic response containing very high order harmonics of the fundamental frequency. Unless the piece has such an elongated shaped, signals containing readily detectable very high order harmonics will not be produced.

As noted above, most magnetic EAS systems operate in a magnetize to desensitize mode. U.S. Pat. No. 3,983,552 (Bakeman et al.) depicts an alternative magnetic EAS system which also uses a dual status marker. In that system, magnetization of a remanently magnetizable "keeper" element causes even order harmonics to be produced, upon which detection in the system is based. While the markers are thus sensitized when magnetized, the marker and system there depicted is not known to have been commercially practiced.

SUMMARY OF THE INVENTION

Like certain of the markers discussed in the references cited above, the marker of the present invention is intended for use in an electronic article surveillance system having within an interrogation zone an alternating magnetic field. Also likewise, the marker comprises at least one piece of low coercive force, high permeability material and at least one piece of remanently magnetizable material. It is at this point, however, that all similarities between prior art markers and the marker of the present invention cease. Every such prior art marker has heretofore utilized at least one piece of high permeability material which is physically dimensioned, such as by being very long and thin, so as to produce a characteristic response upon which an alarm may be based when the magnetization of the entire, magnetically unbiased, piece is reversed by the alternating field in the interrogation zone. In direct contrast, the piece of high permeability material used in the marker of the present invention is physically dimensioned so that it does not work (i.e., produce a response upon which an alarm may be based) when the magnetization of the entire piece is reversed upon exposure to such an alternating field. Thus, the present marker comprises at least one substantially two dimensional piece of low coercive force, high permeability material having overall dimensions such that when the marker is exposed to the alternating field no characteristic response is produced.

As noted above, the marker of the present invention also includes at least one piece of remanently magnetizable material adjacent to at least a portion of the piece of low coercive force material. It has now been found that portions of this piece may be magnetized in a predetermined pattern, i.e., to be magnetically "imaged", so that the field associated with the magnetic image biases only the adjacent portions of the piece of low coercive force material. This bias inhibits magnetic flux changes in those adjacent portions when the marker is exposed to the alternating field such that those portions are magnetically inactive. The remaining, non-biased portions of the piece of low coercive force, high permeability material over which the predetermined pattern of the magnetic image does not extend are sufficiently magnetically isolated so that flux changes will and thus produce a characteristic response. In the present marker, therefore, two critical parameters are present. First, the piece of low coercive force, high permeability material must be dimensioned such that no characteristic response is produced when the magnetization of the entire piece is reversed. Second, a sufficient portion of that piece must be adjacent the piece of remanently magnetizable material so that when that piece is appropriately magnetically imaged, the dimensions of the remaining, unbiased portions of the low coercive force piece are such that a characteristic response will result from magnetization reversal of those remaining portions when the marker is in the alternating field.

Thus, for example, a marker of the present invention which would correspond to the unidirectionally responsive elongated marker disclosed by Elder et al. ('449) could include a square or rectangular piece of low coercive force, high permeability material adjacent to which is placed a remanently magnetizable material which extends over at least a portion of the first piece. The magnetizable material would then be magnetized in a predetermined magnetic image pattern extending over all but a narrow strip shaped portion of the adjacent piece of the low coercive force material. The field associated with the magnetic image biases all but the narrow strip, allowing the narrow strip portion to respond just as though it were an elongated strip. When the magnetic image is removed, such as by demagnetization or magnetization in a different pattern, then the unbiased portion is not capable of producing a characteristic response.

It will thus be appreciated that the specific configuration of the remanently magnetizable material is a matter of choice, so long as a magnetic image pattern may be impressed therein which is capable of inhibiting magnetization reversal in the appropriate portions of the low coercive force material. The magnetizable material may thus overlie only a portion or all of the piece of low coercive force material and may be magnetized in a regular or irregular pattern extending over a part or all of the piece.

In a preferred embodiment, a piece of remanently magnetizable material is magnetized in a predetermined pattern, leaving a remaining unbiased portion of the piece of low coercive force, high permeability material which includes at least one region of reduced cross-sectional area. The reduced cross-sectional area functions as a switching section when sufficient flux from the alternating field is concentrated therein to generate the characteristic response. The pattern also leaves at least one flux collector on each end of said reduced cross-sectional area for collecting flux from the field and concentrating it within the reduced cross-sectional area. In such an embodiment, it is particularly preferred to provide a substantially square section of low coercive force, high permeability material, and to make the predetermined pattern on the remanently magnetizable material substantially circular, and centered within the square section. This leaves a said switching section along each of the four edges and flux collectors at all four corners. Such an embodiment thus results in a marker having substantially equal response in two directions.

DETAILED DESCRIPTION

Figure 1:
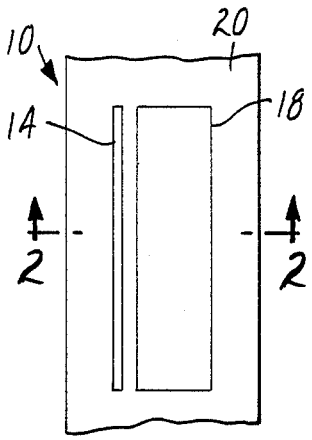
FIG. 1 is a plan view of a marker of the present invention which responds in only one direction.
Figure 2:
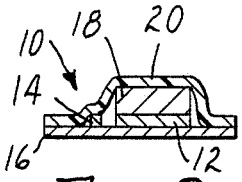
FIG. 2 is a cross-section of the marker shown in FIG. 1, taken along the line 2—2.

One embodiment of the marker of the present invention as shown in FIGS. 1 and 2, emulates the elongated open-strip markers as disclosed in the patents cited hereinabove. As there discussed, the markers comprise an elongated strip of a low coercive force, high permeability material, such as permalloy or the like wherein the ratio of the length to the square root of cross-sectional area is maintained in excess of approximately 150. The reversal of the magnetization within such a strip by an applied field alternating at a predetermined frequency has been found to generate characteristic signals containing readily detectable harmonics of the fundamental frequency, particularly harmonics in excess of the fifteenth order. In contrast, if the piece of high permeability material is not so dimensioned, such a characteristic response will not result. This high harmonic response is believed to be due to the small demagnetizing factor associated with the narrow elongated strip such that the magnetization therein is able to reverse very rapidly, and thereby produce high amplitude, very high order harmonic components. As shown in FIGS. 1 and 2, an equivalent marker 10 of the present invention, comprises two pieces 12 and 14, respectively, of a low-coercive force, high permeability ferromagnetic material, such as permalloy or the like. The two pieces are positioned side by side and sufficiently close together so as to be normally magnetically coupled together and thereby respond as though one piece. The combined width of the two pieces is sufficiently wide such that the ratio of the length to the square root of the cross-sectional area of the combined pieces is significantly less than the aforenoted level of 150. Accordingly, when the marker is subjected to the alternating fields in an interrogation zone, no characteristic response i.e., no signal containing very high order harmonics is produced, and hence no alarm signal is generated. For example, in the embodiment shown in FIGS. 1 and 2, the first piece 12 may have dimensions of 9.5 mm wide by 38 mm long, and be formed of a permalloy foil 0.015 mm thick. Similarly, the narrow piece 14 may be positioned approximately 1.6 mm away from the piece 12 and have dimensions of approximately 1.6 mm wide by 38 mm long, and also be formed of a permalloy foil 0.015 mm thick. The ratio of length to the square root of cross-sectional area of such combined pieces may thus be seen to be approximately 93, whereas the ratio for the narrow strip 14 alone is approximately 245.

As further shown in the cross-sectional view of FIG. 2, the marker 10 desirably includes a carrier support layer 16 on which the various magnetic components may be adhered by a pressure sensitive adhesive layer or the like together with a top layer 20 such as formed of paper or plastic sheeting or the like, which may both protect the magnetic elements and provide a surface of which customer indicia and the like may be included.

In accordance with the present invention, it has now been found that the high harmonic response from such a narrow piece 14 may be drastically reduced by introducing the wider piece 12 magnetically adjacent thereto. When thus positioned, the wider piece may be said to rob flux from the narrow high harmonic generating strip and thereby prevent an appropriate characteristic response from being produced.

The marker 10 is further made to be dual status by including on top of the wider piece 12 another piece 18 of a remanently magnetizable material such as a thin sheet of a ferromagnetic material such as vicalloy, carbon steel or the like. Alternatively, such a material may be a dispersion of ferromagnetic particles such as gamma $Fe_2O_3$ in an organic binder. Preferably, selected particles exhibit a preferred direction of magnetization and are substantially oriented in the dispersion such that the preferred direction of magnetization of the particles are parallel. In the embodiment shown in FIGS. 1 and 2, the layer 18 is preferably a 0.10 mm layer of conventional magnetic recording gamma $Fe_2O_2$ particles in an organic binder coated in a conventional manner directly onto the permalloy sheet. It will be appreciated that the vertical scale shown in FIG. 2 is thus magnified for clarity and may not reflect the actual relative thickness of the various layers.

Figure 3:
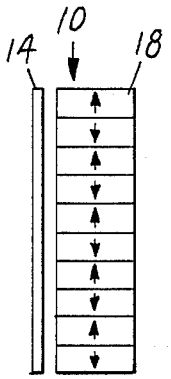
FIG. 3 is a partial plan view of the marker shown in FIG. 1, wherein a predetermined magnetized pattern is present.

When the piece 18 is magnetized with an alternating striped pattern or image as shown by the arrows in FIG. 3, the magnetic fields associated with the magnetic image prevent the magnetization in the underlying wide piece 12 of permalloy from reversing. This in turn prevents the piece 12 from stealing flux from the narrow strip 14 when subjected to interrogating fields, such that the strip 14 is free to independently respond as though the piece 12 was not present. Accordingly, a characteristic response containing requisite harmonic components will be produced, such that the marker may be normally detected.

In contrast, when the magnetic image on the piece 18 is removed, such as by subjecting the piece 18 to a gradually decreasing alternating field to demagnetize it, or by placing the entire piece in a unidirectionally magnetized state by subjecting the piece to a DC field, at least portions of the piece 12 will be able to respond together with the piece 14 when exposed to an interrogating field and under such conditions, the demagnetizing factor will be sufficiently high that no characteristic response may be produced.

When a narrow piece of permalloy such as the 1.6 mm wide by 38 mm piece of permalloy 14 was subjected to certain test conditions simulating that present in a typical interrogation zone, a relative response of 0.8 was observed. The same response was also observed with the marker shown in FIGS. 1, 2 and 3 when the piece 18 is magnetized with a spatially repeating pattern of alternating polarities, the area of each polarity being approximately 2.3 mm wide. When the pattern was erased with an AC field, the corresponding signal produced was found to be only 0.2. Such a difference in sensitivities is sufficient to distinguish between the sensitized and desensitized states, and may be significantly enhanced with optimized constructions. In this and other embodiments of the present invention, the magnetic image to be impressed on the magnetizable piece, such as element 18 of FIGS. 1 and 2, is conveniently provided by exposing the magnetizable material to the external field of a permanent magnet assembly shaped so that the corresponding desired, or predetermined pattern extends over a given area. The image is thus impressed by carefully placing the piece in contact with a permanent magnet assembly, and removing it therefrom without sliding it sideways. The assembly is preferably a strip of rubber-bonded permanent magnet material such as Plastiform Brand magnet strips manufactured by Minnesota Mining and Manufacturing Company having parallel, oppositely magnetized bands or regions in which the intensity of each band extends uniformly from one edge to an opposite edge of the strip. The width of each band is particularly desired to be in the range of 1 to 6 mm. Alternatively, the magnetic structure in the assembly may be shaped to provide other types of patterns, one such other pattern being a checkerboard, rather than stripe configuration, containing blocks of alternate polarities extending in generally orthogonal directions. Each block or region of alternate polarities is desirably in the range between 1 and 6 mm wide in each orthogonal direction.

The preferred magnetic image for sensitizing the marker 10 as shown in FIG. 3 comprises a magnetization pattern of alternating polarity extending the entire length of the piece 18. Such a pattern thus prevents the underlying piece 12 of high permeability material from reversing when the marker is in an interrogating zone and thereby allows the narrow strip 14 to independently respond in the manner described above.

Figure 2A:
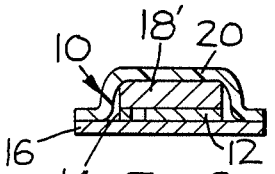
FIG. 2A is a cross-section of a marker slightly modified from that shown in FIGS. 1 and 2.

An alternative construction to that shown in FIGS. 1 and 2, is shown in cross-section in FIG. 2A, in which the magnetizable sheet 18' extends over both sections 12 and 14. In such a construction, the same magnetic image as shown in FIG. 3 would be provided, i.e., a pattern extending the entire length of the piece 18', but in which the pattern extended over only that portion of the width which extends over piece 12. Piece 14 would thus continue to be unbiased and hence free to independently respond.

Figure 4:
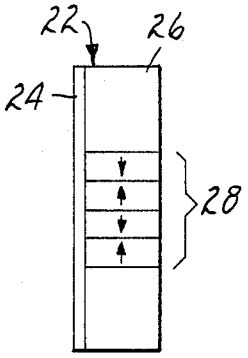
FIG. 4 is a plan view of another embodiment of a single directionally responsive marker having a different predetermined magnetized pattern.

A marker substantially like that shown in FIGS. 1, 2, and 3 may also be formed of a single sheet of high permeability material. Such a marker 22 is shown in FIG. 4 to include a relatively wide rectangle 24 of low coercive force, high permeability material such as permalloy, over which is placed a slightly narrower rectangle 26 of permanently magnetizable material. Thus in a specific construction as shown in FIG. 4, the piece 24 is a 12.5 mm wide by 38 mm long piece of 0.015 mm thick permalloy, over which is placed an 11 mm wide by 38 mm long dispersion of gamma $Fe_2O_2$ particles in an organic binder, 0.10 mm thick. Such a marker may be magnetized in the pattern shown in FIG. 3. When tested as described above, the sensitivity was observed to be about half that exhibited when the two pieces were spaced apart as shown in FIGS. 1–3. This inferior performance is believed to be the result of fringe fields from the magnetized piece 26 extending over the adjacent, nominally unbiased portion of the piece 24.

Alternatively, it is only necessary to magnetize a small section of the oxide layer with the alternating pattern. Thus as shown in FIG. 4, only a narrow center region 28 is shown to be magnetized with the alternating pattern, thereby effectively removing only that portion of the piece of the high permeability permalloy sheet 24 which is directly below the magnetized region 28. When such a magnetic image is present, the portions of the underlying permalloy piece 24 which are outside of the magnetically imaged area are able to magnetically respond, and to function as flux collectors, thereby causing flux to be concentrated within the remaining narrow strip region adjacent the magnetic pattern area. When tested as described above, a relative signal of 0.5 was observed. When that magnetic pattern was removed, the desensitized signal was correspondingly observed to be approximately 0.09.

Figure 6:
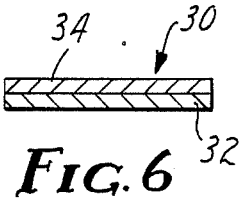
FIG. 6 is a cross-sectional view of the embodiment shown in FIG. 5, taken along the lines 6—6 wherein the top and bottom sheets are co-extensive.
Figure 5:
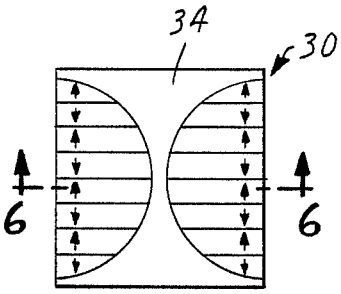
FIG. 5 is a plan view of yet another embodiment of a single directionally responsive marker.

An alternative embodiment of a marker providing a single directional response and in which flux collectors analogous to those provided in the embodiment described above in conjunction with FIG. 4, is set forth in FIGS. 5 and 6. As may there be seen, such a marker 30 comprises two overlapping pieces, a first piece 32 of a high permeability, low coercive force material, such as permalloy or the like, and on top of which is positioned a piece 34 of remanently magnetizable material. The dimensions of both pieces may typically be in the form of a square or broad rectangle, such as, for example, 2.54 cm square pieces of both such materials. While not shown in those figures, the construction of the marker may be similar to that shown in conjunction with FIGS. 1 and 2 in which the marker further comprises underlying support layers of paper or plastic sheet or the like, as well as cover layers for providing customer indicia and the like.

Analogously to that described in conjunction with the above figures, when the remanently magnetizable material 34 is unmagnetized, the entire sheet 32 of high permeability material is free to respond to the interrogating fields, and due to the large demagnetizing factor associated therewith, a characteristic response containing high order harmonic signal components will not be produced. Alternately, the remanently magnetizable layer 34 may be imaged with a magnetic pattern such as shown in FIG. 5, wherein bands of alternately magnetizable poles are placed in semicircular patterns on both sides of the marker, leaving a narrow center region and top and bottom regions of large cross-sectional area of unmagnetized material. Accordingly, the narrow cross-sectional center portion of the underlying high permeability material is able to act as a switching section in which the magnetization is able to rapidly reverse when present in an interrogating field and to thereby produce a characteristic response containing high order harmonics when sufficient flux is concentrated therein by the large top and bottom areas which act as flux collectors.

Figure 7:
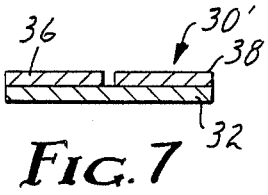
FIG. 7 is a cross-sectional view of an alternative embodiment also corresponding to that shown in FIG. 5 and taken along the lines 6—6, but wherein the top and bottom sheets are not co-extensive.

In some instances, as in FIGS. 5–7, the magnetized pattern may be shaped such that the remaining, unbiased portion of the low coercive force, high permeability sheet 32 exhibits a gradual transition between the region of reduced cross-sectional area, which acts as the aforementioned switching section, and the adjacent top and bottom regions of large cross-sectional area, and which thus act as flux collectors. In such an instance, it is convenient to define the limits of the region of reduced cross-sectional area as having a minimum width and a length which is somewhat arbitrarily said to terminate at opposite points at which the width parallel to the minimum width is no longer less than five times the minimum width. Thus, for example, in the preferred embodiment shown in FIG. 5, the minimum width of the region of reduced cross-section is desirably in the range of 0.003 to 0.03 $mm^2$, and the length of the region is less than 2.0 cm. If as is typical, the sheet 32 is a thin metal foil such as the 0.015 mm (0.6 mil) thick sheets employed in the examples discussed below, the region of minimum width of the region of reduced cross-sections must then vary between 0.2 and 2.0 mm. Thus if the minimum width of 0.76 mm (well within the allowed range specified in the examples) is selected, it may be readily recognized that the length at which points the width is five times the minimum width will be about 12 mm for the construction of FIGS. 5–7, and about 16 mm for the construction of FIGS. 8–10, i.e., well within the recited upper bound of 2.0 cm.

While a striped pole pattern is shown in FIG. 5, it is similarly recognized that the pattern may be striped, checkerboard or any other pattern so long as the underlying areas of the high permeability material are magnetically isolated and thereby do not significantly affect or contribute to the response of the non-adjacent and hence non-biased portions of the high permeability piece.

As shown in conjunction with FIG. 4 above, the piece of remanently magnetizable material need not be extensive with the underlying sheet of high permeability material. Thus, as shown in the cross-sectional view of FIG. 7, an analogous marker 30' may be constructed which would appear in plan view to be the same as that shown in FIG. 5. However, unlike that shown in FIG. 6, and as shown in the cross-sectional view of FIG. 7, two semicircular sections 36 and 38 of remanently magnetizable material are applied over the high permeability piece 32. Each of the pieces 36 and 38 are thus intended to be magnetized in a magnetic pattern, such as shown in FIG. 5, leaving therebetween the unbiased hourglass pattern.

Figure 8:
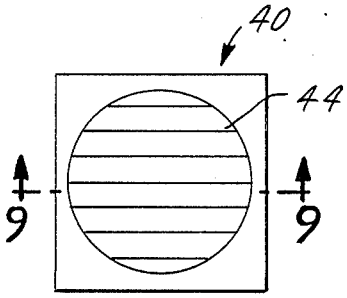
FIG. 8 is a plan view of a two directionally responsive marker of the present invention.

As further shown in FIG. 8 and the corresponding cross-sectional views 9 and 10, a further embodiment of the marker 40 or 40' of the present invention may comprise a square of low coercive force, high permeability material 42 similar to that used in the markers shown in FIGS. 5, 6, and 7. On top of the material 42 is positioned a piece 44 or 44', of remanently magnetizable material. In the embodiment shown in cross-sectional view 9, the remanently magnetizable piece 4 is shown to be coextensive with the underlying piece 42 of low coercive force, high permeability material. In such an embodiment, a magnetic pattern or image in the form of a circle containing parallel bands of spatially alternating polarities is impressed on the square of remanently magnetizable material 44. Alternatively, in the cross-sectional view shown in FIG. 10, the remanently magnetizable material 44' is present as a discrete circular layer in which a magnetization pattern of spatially alternating polarities may be impressed.

In both embodiments, such a pattern or image has associated therewith a localized magnetic field which biases an underlying circular portion of the low coercive force, high permeability material, thereby effectively removing that circular portion and preventing it from magnetically responding when the marker is present in an interrogation zone. Accordingly, the remaining peripheral portions of the square of low coercive force, high permeability material 42 are free to respond as though those portions alone were present. As the width of the remaining portion at the mid-point along each edge is relatively thin, those portions are able to function as switching sections and to generate a characteristic response. The remaining corner portions function as flux collectors to ensure that sufficient flux from an interrogating field is present within the switching sections. As the switching sections extend in two directions at right angles to each other, such a marker may be readily recognized as being responsive in two directions, as opposed to the one directionally responsive markers discussed heretofore.

Figure 9:
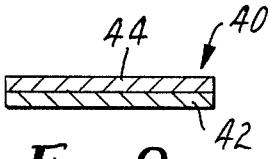
FIG. 9 is a cross-sectional view of the embodiment shown in FIG. 8, taken along the lines 9—9, wherein the top and bottom sheets are co-extensive.

One example of a marker such as described in conjunction with FIGS. 8 and 9 was prepared of a 2.54 cm square section of 0.015 mm thick permalloy, onto one surface of which was adhered via a layer of spray adhesive a 0.13 mm thick layer of oriented gamma $Fe_2O_2$ particles in an organic binder, prepared as a magnetic recording media on a polyester base. This marker was subsequently magnetized with a circular pattern containing parallel, 1.4 mm wide regions of alternating polarity across a center circular area, leaving non-magnetized regions 1.6 mm wide adjacent the mid-points of each edge.

The magnetic image pattern was applied by placing against the backside of the iron oxide layer a circular section of 0.8 mm thick Plastiform Brand rubber-bonded magnet material magnetized to have bands of alternating polarity poles 1.4 mm wide extending across the surface. In doing so, it is preferable that the magnet material be positioned such that the associated fields are parallel to the orientation of the easy axis of the oxide. When the oxide layer was thus magnetized, thereby providing switching sections adjacent the mid points of each side of the marker, sensitivities measured as described above of 0.63 were observed. Alternatively, when the magnetized pattern of the iron oxide layer was removed by subjecting the marker to an alternating magnetic field gradually decreasing in intensity, the marker was found to exhibit a sensitivity of 0.005, such that the marker could not be detected.

Figure 10:
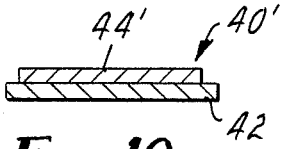
FIG. 10 is a cross-sectional view of an alternative embodiment also corresponding to that shown in FIG. 8 and taken along the lines 9—9, but wherein the top and bottom sheets are not co-extensive.

In a similar test, a marker as shown in FIGS. 8 and 10 was prepared from a 2.54 cm square piece of 0.015 mm thick permalloy onto which was placed a circular piece of Plastiform Brand rubber-bonded magnet material, which was 0.8 mm thick and was magnetized to have 1.4 mm wide regions of alternating polarities extending across the circular piece. The magnetized piece was dimensioned to leave narrow sections of unbiased permalloy having a width of approximately 2.0 mm between the outer periphery of the disc and the mid-point of each square edge. When the thus biased permalloy piece was tested as described hereinabove, the sensitivity of 0.64 was observed when a straight edge of the piece was aligned with the test field. Alternatively, when the biasing field was removed, in this instance by simply removing the magnet piece from the underlying piece of permalloy, the sensitivity was 0.005, such that the piece could not be detected.

In an analogous example, a 0.13 mm thick layer of oriented $\gamma$-$Fe_2O_2$ particles in an organic binder as described above, was cut into a circular shape, and adhered via a spray adhesive to a 2.54 cm square piece of 0.015 mm thick permalloy, leaving narrow bands adjacent the mid-point of each straight edge. The disc shaped piece was then magnetized with a magnetic image pattern by momentarily contacting the same Plastiform Brand rubber-bonded magnet material as described in the preceding example directly onto the oxide layer, with the poles oriented parallel to the oxide particles. When the thus sensitized tag was tested as described above, a sensitivity of 0.6 was observed when the marker was aligned with the applied field, and alternatively, when the pattern was removed by subjecting the tag to a gradually decreasing AC field, a sensitivity of 0.005 was observed, thereby showing that the tag could not be detected.

The above examples of a two-dimensional marker are described to have been made with a layer containing a dispersion of oriented remanently magnetizable particles. In a further example, a 0.13 mm layer of non-oriented iron oxide particles in an organic binder was similarly placed over and coextensive with a 2.54 cm square of 0.015 mm thick permalloy. When a circular magnetic pattern containing parallel, 1.6 mm wide regions of alternating polarities was similarly impressed therein as described above, the marker was observed to be sensitized, and a sensitivity of 0.5 was observed when one of the perpendicular straight edges was aligned with the applied field. Similarly, when the magnetic pattern was removed by subjecting the marker to a gradually decreasing AC field, a sensitivity of 0.01 was observed, thus again showing that the marker was desensitized.

The amount of remanently magnetizable material which is desirably present adjacent the layer of low coercive force, high permeability material is generally a matter of choice, and will depend upon the intensity of the external magnetic fields that may be provided when such a material is magnetized. Thus, for example, when non-oriented iron oxide particles in an organic binder are used, a greater amount of material may be desired, such as by providing a layer of such oxide particles on both sides of the high permeability sheet. Where a very strongly magnetic material, such as a Plastiform Brand rubber-bonded magnet material is directly utilized, significantly less material may be needed. In various other tests, markers were formed of 2.54 cm square pieces of 0.015 mm thick permalloy, adjacent to one or both sides of which were positioned 0.05 mm sheets of remanently magnetizable metals such as vicalloy and magnetic stainless steel. Alternatively, dispersions of organic binders and various magnetic particles such as barium ferrite, fine iron, and other particles typically used in magnetic recording media were positioned adjacent to the permalloy square pieces. Such sample markers all exhibited similar performance to that described above.

Figure 11:
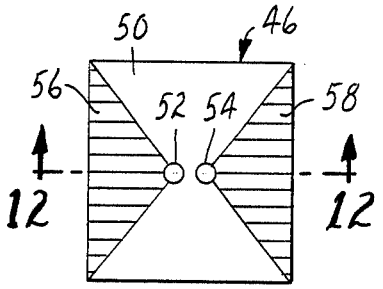
FIG. 11 is a plan view of another single directionally responsive marker.
Figure 12:
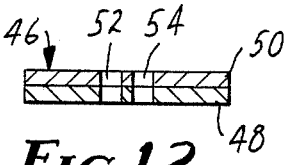
FIG. 12 is a cross-sectional view of the embodiment shown in FIG. 11, taken along the lines 12—12.

Due to the divergence of the external magnetic fields from the magnetic image patterns provided in the remanently magnetized layers, it has been further found desirable to more precisely identify the dimensions of the switching section. A preferred manner of so doing has been to provide small spaced-apart holes through the permalloy piece so that the distance between the holes defines the width of the switching section. It is preferred that the holes be spaced apart a distance in the range of 0.125 to 1.25 mm. Thus as shown in FIGS. 11 and 12, a marker 46 very functionally similar to that shown in FIGS. 5 and 6 was provided, wherein the marker includes a 2.54 cm square section of 0.015 mm thick permalloy 48, on top of which is provided a layer 50 of gamma $Fe_2O_2$ particles in an organic binder as described above. In this embodiment, two 3.2 mm diameter holes 52 and 54 were punched through the assembled pieces, leaving a 0.76 mm space therebetween to define the switching section. The marker 46 was then sensitized by applying a magnetic image to the layer 50 in the form of two triangular sections 56 and 58, which image comprised parallel bands of alternating magnetic polarity. The magnetic image was again provided by placing thereover similarly dimensioned pieces of Plastiform Brand rubber-bonded magnet material. When thus sensitized, the marker was inserted in the test field such that the remaining non-biased portions forming flux collectors were aligned with the field, and a relative sensitivity of 0.60 was observed. Alternatively, when the magnetic image patterns were removed, a sensitivity of 0.005 was observed, such that the marker could not be detected under normal conditions.

Figure 13:
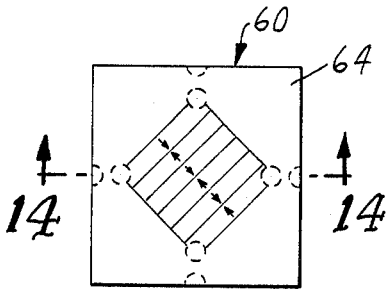
FIG. 13 is a plan view of another two directionally responsive markers.
Figure 14:
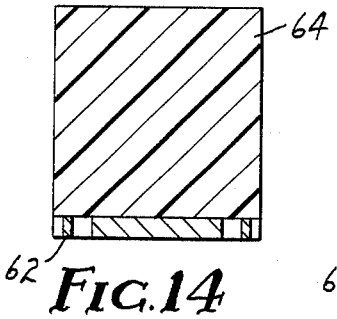
FIG. 14 is a cross-sectional view of the embodiment shown in FIG. 13, taken along the lines 14—14, in which a top sheet is co-extensive with a bottom sheet.
Figure 15:
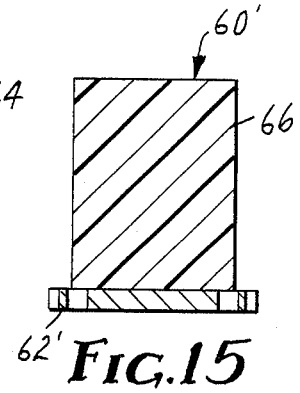
FIG. 15 is a cross-sectional view of an alternative embodiment also corresponding to that shown in FIG. 13 and taken along the lines 14—14, but wherein the top and bottom sheets are not co-extensive.

An analogous preferred construction of a marker wherein a two-directional response is provided, is shown in FIGS. 13, 14 and 15. In FIGS. 14 & 15, the vertical scale is magnified for purpose of clarity. In the first embodiment shown in FIGS. 13 and 14, a 2.54 cm square, 0.015 mm thick piece of permalloy was punched with 3.2 mm diameter holes adjacent the mid points of each of the four sides. Semicircular notches were also punched in each edge, leaving a gap between each hole & adjacent notch, thereby defining a switching section between each pair of holes and adjacent notches. It is preferred that the holes be spaced a distance in the range of 0.125 to 1.25 mm form the adjacent edges, or from an adjacent notch when so provided to define regions of reduced cross-sectional area, i.e., switching sections. In this specific example, a gap of 0.76 mm was provided. It is known that mechanical working such as occurs during punching operations alters the magnetic characteristics of the crystalline permalloy sheet, and thereby lessens the magnetic performance of a marker made therefrom. Accordingly, the sheet 62 was heat treated after punching. Analogously, such holes or notches, of whatever shape, may be provided by conventional etching techniques, and thereby avoid such lessened performance. A coextensive layer 64 of 0.13 mm thick oriented iron oxide in an organic binder layer was then adhered to the punched and heat-treated permalloy sheet. A magnetic image was then applied, as shown in FIG. 13, such that bands of alternating polarity poles extended in a generally square pattern from one pair of holes, to the opposite pair of holes, leaving unbiased portions in the four corners of the permalloy sheet which function to collect flux into the adjacent switching sections. This magnetic image pattern was applied as described above, by positioning a similarly dimensioned magnet assembly having a spatially alternating pattern of 1.25 mm magnetized regions adjacent to it and subsequently removing it without sliding it sideways. When the thus sensitized marker was tested as described above by aligning the marker with either of the sides parallel to the applied magnetic field, a sensitivity of 0.78 was observed, thus showing the superior performance of such a defined switching section over the embodiment shown in FIGS. 8, 9, and 10. Alternatively, when the magnetic image pattern was removed by subjecting the marker to a gradually decreasing intensity field, a sensitivity of 0.01 was observed, thus showing the marker would not normally be detected.

There is an inherent assymetry in markers such as shown in FIG. 8, in which the magnetization pattern, and hence the associated fringing fields, are parallel to one pair of switching sections, and perpendicular to the other pair. Because the fringing fields are different for these pairs of switching sections, the response of the marker is different for fields aligned with one pair and not with the other. This difference may be overcome by aligning the magnetization pattern at 45° to both pairs of switching sections, as shown in FIG. 13.

In an analogous embodiment shown in FIG. 15, a marker 60' was formed of a similarly dimensioned, punched and heat treated sheet of permalloy 62', but wherein the overlying remanently magnetizable piece 66 was a rectangle dimensioned to fit within the inner facing four small holes such that when magnetized in a similar pattern to that shown in FIG. 13, substantially the same performance resulted.

Figure 16:
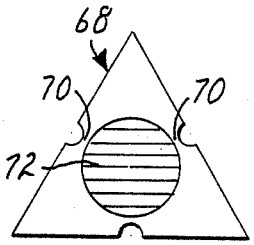
FIG. 16 is a plan view of a generally triangular multidirectionally responsive marker of the present invention.
Figure 17:
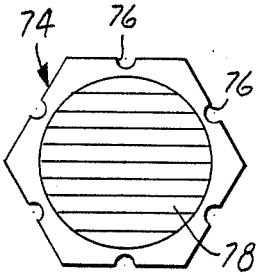
FIG. 17 is a plan view of a generally hexagonal multidirectionally responsive marker of the present invention.

Multi-directional response may also be obtained by providing markers of a variety of shapes. Preferably, regular polygons are so used to minimize waste in cutting such markers from large sheets of a high permeability material. Thus as shown in FIG. 16, a marker 68 may be provided in generally triangular shape, in which three switching sections 70 are provided in the space between small holes punched at the mid points of each of the three sides and a center circular area defined by a circular magnetic image pattern. As described in the embodiments above, such a pattern may be provided by a sheet of remanently magnetizable material coextensive with the triangular permalloy piece which is magnetized to have a magnetic image pattern as described above. Alternatively, a similar magnetizable sheet may be cut into a circular pattern and positioned at the mid point of the triangular sheet. Similarly, as shown in FIG. 17, multidirectional response may be provided in a marker 74, in which a low coercive force, high permeability sheet is cut into a hexagonal shape, and switching sections are provided by punching holes at the mid points of all six sides leaving a narrow gap between the holes 76 and a circular center section 78, which is defined by a magnetic image pattern formed as described in conjunction with FIG. 16.

Figure 18:
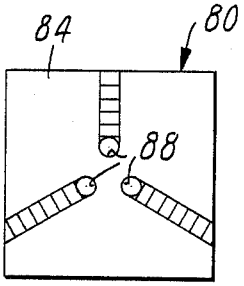
FIGS. 18 and 19 are plan views of alternative embodiments showing different magnetic image patterns.
Figure 19:
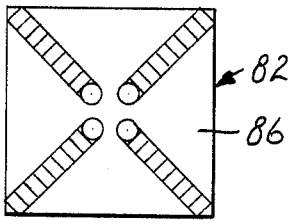

The requisite breaking up of a large two dimensional sheet of low coercive force, high permeability material into zones containing one or more switching sections and a plurality of flux collectors may be done in a variety of other ways. For example, as shown in FIGS. 18 and 19, markers 80 and 82 respectively are shown to be formed of square pieces of a low coercive force, high permeability material, on top of which are coextensive squares 84 and 86 respectively of a remanently magnetizable material. The marker 80 has punched through at least the underlying low coercive force, high permeability material, three small holes 88 so as to define therebetween regions of reduced cross-section, which regions subsequently function as switching sections. The overlying remanently magnetizable layer 84 is then subsequently magnetized with an image pattern consisting of three narrow bands of alternating polarity poles radiating outward from each of the three holes 88 to each edge. As thus imaged, the portion of the low coercive force, high permeability sheet below the imaged bands are magnetically disabled, thus allowing the remaining large areas to function as flux collectors for the center positioned switching sections. When the magnetic patterns are removed, the entire piece of the underlying high permeability material will be able to uniformly reverse, and the demagnetizing factor will be such as to prevent a characteristic response from being produced.

Analogously, in FIG. 19 the marker 82 is formed of a sheet of permalloy in which four holes are positioned toward the center of the marker, the space between each of the holes being such as to define a switching section therebetween. The remanently magnetizable sheet 86 has impressed therein a magnetic pattern including bands of alternating polarities radiating outward from each of the four holes to the edge of the marker. Such a marker thus functions like that described in conjunction with FIG. 18 but wherein response in substantially two orthogonal directions is provided. It may again be noted that the holes provided in either of the markers 80 or 82 are preferred, in that they define the dimensions of the switching elements and hence ensure more uniform performance. It should also be remembered that the image area is the only area that need be coated or have an overlying layer of remanently magnetizable material, and that that material need not be coextensive with the underlying layer of low coercive force, high permeability material.

Figure 20:
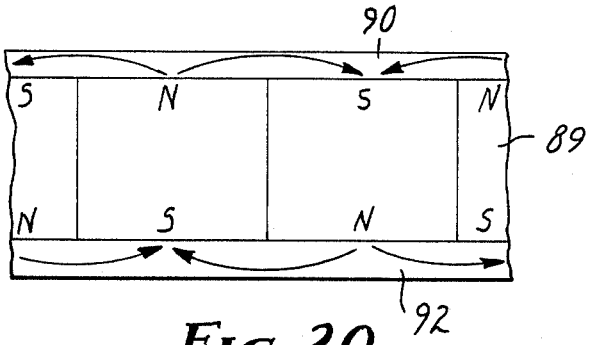
FIG. 20 is a schematic view of another embodiment showing the manner in which flux emanating from a center permanently magnetized sheet is coupled through outer sheets of low coercive force material.

A schematic view of a construction for providing the magnetic image in the layer of remanently magnetizable material utilized in the markers of the present invention is shown in FIG. 20. As may there be seen, such a device includes a layer 89 of permanently magnetized magnet material such as Plastiform Brand rubber-bonded permanent magnet material, which is magnetized with a patterm of spatially alternating polarities extending through the thickness of the layer. A thin sheet of a soft ferromagnetic material 90 is then placed on top.of the permanent magnet material 89 to provide a low reluctance path for the magnetic flux leaving the top surface of the assembly. Such an assembly is then positioned in contact with the remanently magnetizable layer 92 of the markers, such that the external fields are coupled through the magnetizable material and cause a magnetized state to be impressed therein. The spacing between the alternating regions in such a material is also a matter of various tradeoffs. The closer together the oppositely polarized regions become, the better the control over the location and dimensions of the magnetic image. Alternatively if the pattern is too large, the flux from the imprinted pattern will tend to diverge into the switching or collector portions of the tag such that poor performance will be observed. If the pattern is too small, the external field pattern associated with it may be insufficient to properly immobilize the high permeability material therebelow. The permanently magnetizable material 89 can be magnetized either perpendicular or parallel to the plane of the soft magnetic overlying layer 90.

Figure 21:
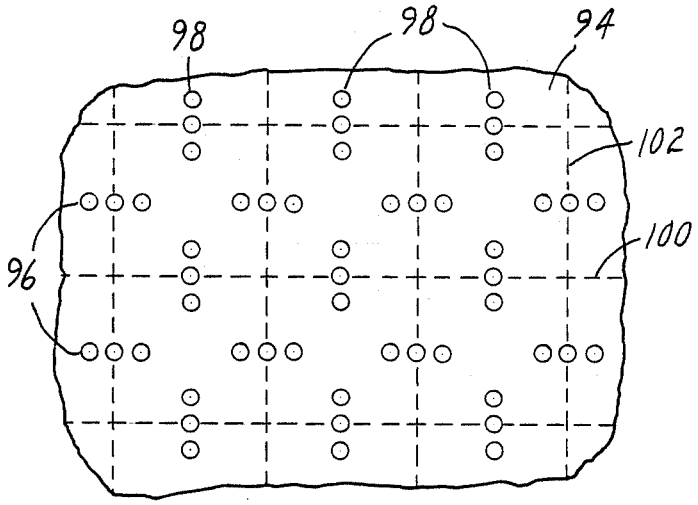
FIG. 21 is a plan view showing a plurality of markers as shown in FIG. 13, formed in a large web.

A further benefit obtained by providing a series of small holes in a large web of low coercive force, high permeability material is further illustrated in FIG. 21. As there illustrated, such a large web 94 is desirably punched with repetitive series of three adjacent holes extending in both rows and columns 96 and 98 respectively, which sets of three holes are spaced apart from each other such that the distance between the center and outer holes defines the width of corresponding switching sections in a subsequently completed marker as discussed hereinabove. The markers are subsequently completed by severing the web along the dotted horizontal and vertical lines 100 and 102 respectively. By providing the center most hole in each series of three holes, the location of the cut lines 100 and 102 need not be accurately positioned, as long as the line is anywhere within the confines of the center most hole of each set of three holes.

Figure 22:
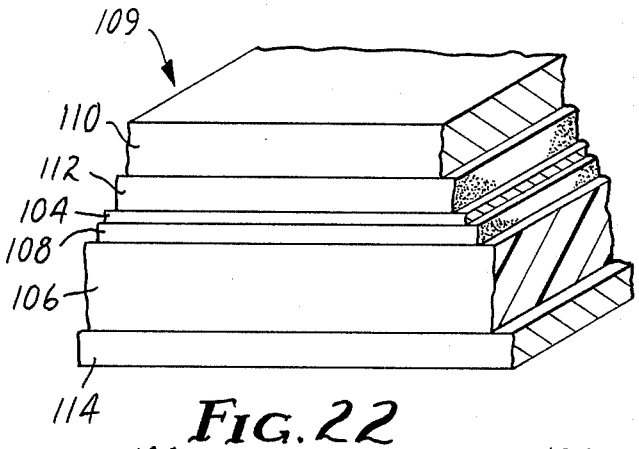
FIG. 22 is a perspective view of the web shown in FIG. 21, showing relative thicknesses of the respective layers and sheets.

A perspective cross-sectional view of a completed preferred construction of a marker of the present invention is shown in FIG. 22. As may there be seen, such a marker comprises a thin sheet 104 of low coercive force, high permeability material, such as a 0.015 mm thick sheet of permalloy, adjacent a sheet 106 of a remanently magnetizable material. The sheet 106 is preferably an approximately 0.13 mm thick dispersion of gamma $Fe_2O_2$ particles in a polymeric binder. These respective layers are in turn bonded together with an adhesive layer 108, such as a 0.025 mm thick layer of a suitable transfer adhesive. An outer paper layer 110 is desirably added to allow printed indicia to be added to the marker, which layer is in turn bonded to the low coercive force, high permeability layer 104 via a 0.025 mm thick transfer adhesive layer 112. Similarly, the bottom of the marker may typically be a 0.10 mm thick layer 114 of paper or plastic sheeting or the like to provide an overall structural support for the marker, which layer may similarly be bonded to the iron oxide layer 106 via a separate adhesive (not shown). Alternatively, the bottom support layer 114 may be a substrate on which the dispersion of iron oxide and polymeric binder are coated.

Figure 23:
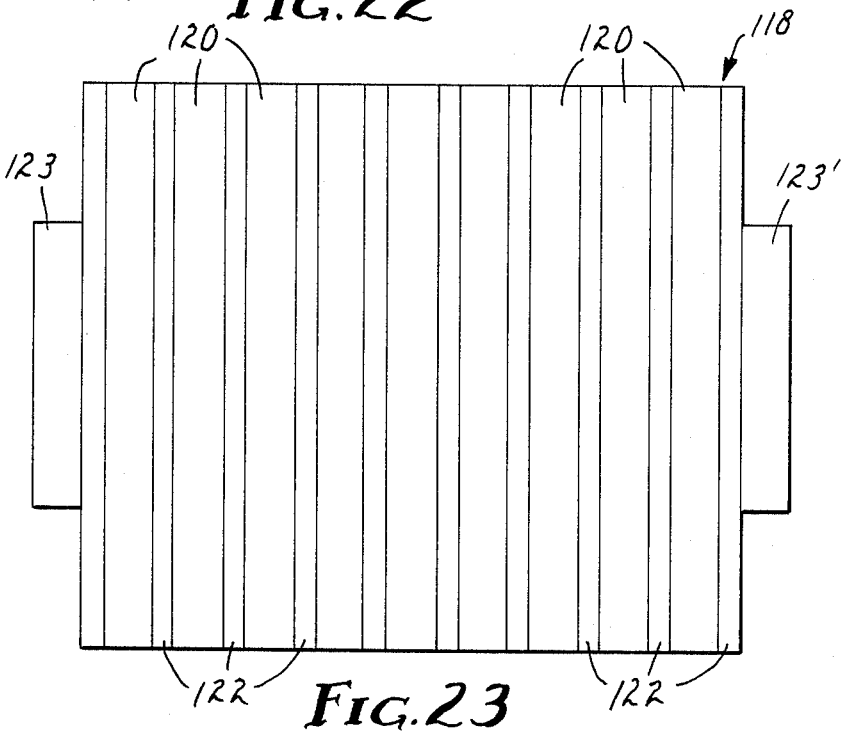
FIG. 23 is a plan view of a permanent magnet assembly for providing a predetermined magnetized pattern in a marker such as shown in the embodiment of FIG. 13.
Figure 24:
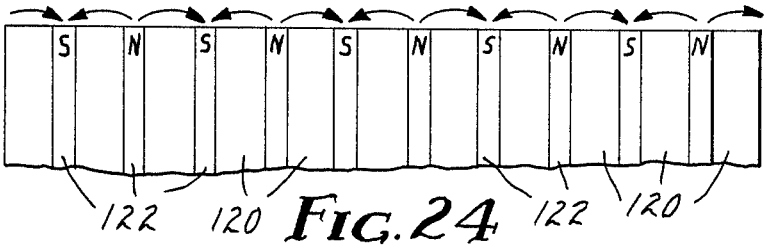
FIG. 24 is a schematic view of the field pattern provided by the assembly shown in FIG. 23.

A preferred structure for providing the magnetic image pattern shown in FIG. 13 is shown in the plan and schematic views respectively of FIGS. 23 and 24. As the square magnetic image pattern of the 2.54 cm square marker shown in FIG. 13 is approximately 12 mm wide on each side, the magnetic structure 118 is similarly dimensioned. Such a structure is desirably assembled from nine sections 120 of Plastiform Brand rubber-bonded magnet pieces which are assembled between 0.34 mm pieces of magnetically soft steel 122. The pieces of magnet material are oriented to provide magnetic poles of alternate polarities in the interlying steel sections 122, as shown in FIG. 24.

Half-width bucking pole pieces 123 and 123' are used in each end of the imaging magnets so that substantially no flux comes out of the ends of the magnet assembly. Such an assembly in turn creates images on the markers in which a net zero flux comes out of the ends of the image. This type of image does not bias the marker when it switches, and has been found preferable as biased markers create even order harmonics which may be undesirable.

Figure 25:
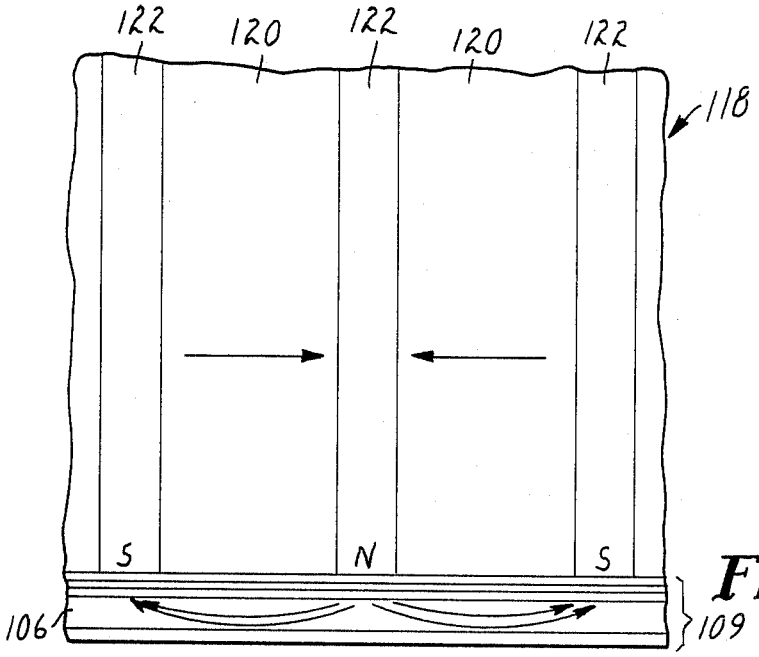
FIG. 25 is a detailed partial schematic view of the assembly shown in FIG. 23 with a marker adjacent to the assembly.

The fields provided by the assembly 118 when adjacent a section of a marker 109 having the cross-section shown in FIG. 22, is set forth in FIG. 25. As may there be seen, the sections 120 of permanently magnetized material are assembled with alternate polarities facing each other, such that alternate poles are formed at the interleaved soft steel sections 122. The external fields from those poles in turn pass through the marker 109 and create lines of flux within the layer of remanently magnetizable material 106 as shown in FIG. 25. When the structure 118 is withdrawn in a direction perpendicular to the surface of the marker 109, the magnetic pattern remains imprinted within the layer 106.

Figure 27:
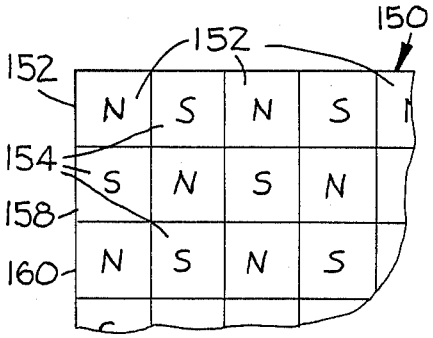
FIG. 27 is a plane view of an alternative permanent magnet structure for providing a predetermined magnetized pattern in a marker.

An alternative structure for providing a checkerboard pattern rather than the striped patterns described hereinabove, is depicted in FIG. 27. In the top view there shown, a checkerboard pattern 150 may be provided in a homogeneous sheet of a rubber-bonded magnet material which oppositely magnetized zones 152 and 154 respectively have been formed, such as by conventionally exposing the sheet to fields of appropriately positioned and energized electromagnets. Also, in a manner similar to that described in conjunction with FIG. 25, such a magnetic checkerboard pattern 150 may be formed by assembling discrete strips 156, 158 and 160 of such a material, side-by-side, in which each strip has equally spaced zones of opposite magnetic polarity extending along the strip, and every strip is off-set from the adjacent strip by a distance equal to the width of each magnetic zone.

Figure 26:
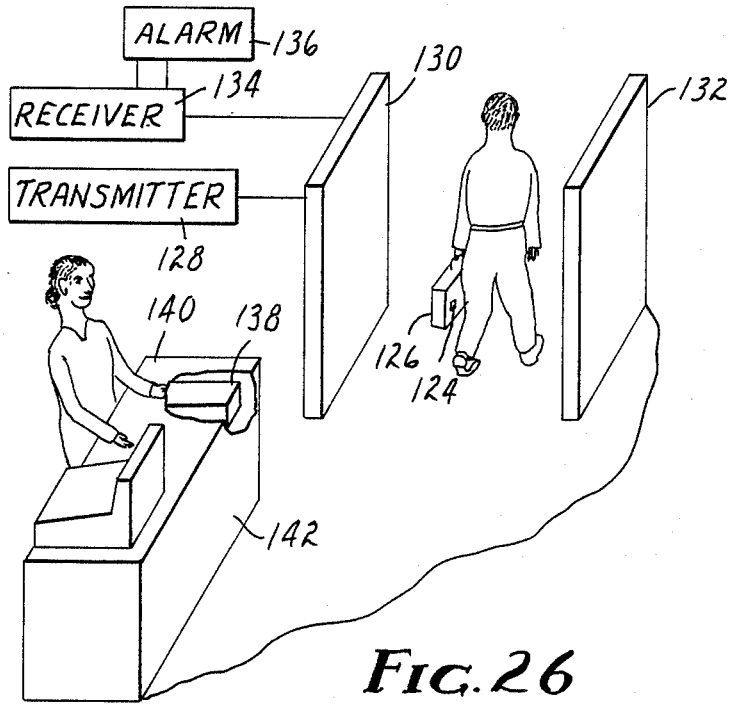
FIG. 26 is a perspective-block diagram of a system of the present invention.

The manner in which a marker such as described hereinabove would be preferably used within an electronic article surveillance system is shown in FIG. 26. As there shown, a marker 124 would be secured to an article 126 which is to be protected. The system includes a transmitter 128 for energizing transmitting coils contained within the interrogation panels 130 and 132, thereby creating an alternating magnetic field within the interrogation zone within which one exiting the protected area would leave. In a preferred embodiment, such a field would be alternating at a predetermined frequency. The system further comprises a receiver 134 coupled to receiving coils located within the panels 130 and 132, which receive and detect signals produced in the interrogation zone as a result of the interaction of the marker 124 with the fields produced by the transmitter 128. When a characteristic response produced by such a marker is detected, the receiver produces an appropriate signal to activate the alarm 136. Such an alarm may, as well known to those skilled in the art, be either audible, visual, (such as by flashing an indicating light), or mechanical (such as by locking a turnstile or other exit preventing mechanism). The system further includes a desensitizing apparatus 138, such as may be concealed below the surface 140 of a merchandise checkout counter 142. The device 138 may simply be a permanent magnet assembly which creates a unidirectional magnetic field, or alternatively may create an alternating polarity magnetic field. In the first instance, as an article 126 containing a marker 124 is passed along the counter the unidirectional magnetic field created by the device 138 will remove the magnetic image pattern in the marker and cause the remanently magnetizable material therein to assume a substantially unidirectionally magnetized state. Alternatively, if the device 138 produces an alternating field pattern, as the article 126 containing the marker 124 is passed therealong and gradually removed from the vicinity of the device 138, the gradually decreasing fields of alternate polarity will result in the remanently magnetizable material within the marker 124 being left in a demagnetized state. In either case, as the magnetic image has been removed, the marker has been desensitized, such that one carrying the article through the interrogation zone may pass without causing an alarm to occur. As discussed hereinabove with regard to preferred constructions of the marker which are appropriately dimensioned so as to cause the marker to generate high order harmonics, the transmitter 128 will be constructed to generate fields of a predetermined frequency and the receiver 134 designed to detect and respond to such high order harmonics of that frequency thus recognizing such signal components as a characteristic response which is necessary in order to activate the alarm 36.

It should be recognized that in the descriptions of the various embodiments of the markers discussed hereinabove, the dimensions of the markers as shown in the figures are generally not to scale, the vertical dimensions typically being greatly magnified for purposes of clarity. Similarly, in several figures, magnetic field patterns have been shown as though visible through a magnetic viewing device, whereas in their normal state, one would not discern whether or not the magnetic image patterns are present.

While in the majority of the embodiments discussed above, a single thin sheet of permalloy has been utilized as the magnetically active element, it is similarly within the scope of the present invention that other low coercive force, high permeability materials may similarly be used. Particularly, it is recognized that the strain sensitivity of such crystalline materials may be avoided by utilizing low coercive force, high permeability amorphous alloys. For example, in one case a 2.54 cm square marker was formed of a 0.020 mm thick sheet of amorphous material having the following nominal composition (at.%):69% Co, 4.1% Fe, 3.4% Ni, 1.5% Mo, 10% Si and 12% B, over which was positioned a similarly dimensioned 0.13 mm thick layer of magnetic oxide oriented 45° with respect to the square edges of the marker. The marker was similarly punched with patterns of three adjacent holes as shown in FIG. 13, with the dipole switching sections being 0.89 mm wide. Such a marker was found to exhibit a sensitivity when in the sensitized state quite similar to that obtained with markers formed of crystalline permalloy, and may be preferred inasmuch as a heat treatment stage may be avoided.

I claim:

1. A marker for use in an electronic article surveillance system having within an interrogation zone an alternating magnetic field, said marker comprising at least one substantially two dimensional piece of low coercive force, high permeability material having overall dimensions such as to prevent the production of a characteristic response when the marker is exposed to a said alternating field, and at least one piece of remanently magnetizable material adjacent at least a portion of the piece of low coercive force material, whereby magnetization of said remanently magnetizable material in a predetermined pattern creates a corresponding field which biases only those portions of said piece of low coercive force material adjacent to the magnetized predetermined pattern, and thereby inhibits magnetic flux changes in those adjacent portions the dimensions of the remaining, non-biased portions of said piece of low coercive force material being such that a characteristic reponse will result when the marker is in a said field.

2. A marker according to claim 1, wherein said two dimensional piece of low coercive force, high permeability material consists of at least one first section and at least one second section of such material, with each said second section being magnetically coupled to a said first section, and wherein said remanently magnetizable material extends over only said second sections so that when magnetized in a said predetermined pattern the field associated therewith inhibits magnetization reversal only in said second sections.

3. A marker according to claim 1, wherein said two-dimensional piece of low coercive force, high permeability material consists of at least one first section and one second section with each said second section being magnetically coupled to a said first section, and wherein said remanently magnetizable material extends over all of said sections, but the magnetic field associated with a said predetermined pattern magnetized in said piece of remanently magnetizable material extends proximate to only said second sections and thereby inhibits magnetization reversal only in said second sections.

4. A marker according to claim 3, wherein each said first section comprises an elongated piece of low coercive force, high permeability material having a ratio of length to square root of cross sectional area not less than 150 such that when exposed to a said field alternating at a predetermined frequency, a said characteristic response containing readily detectable harmonics in excess of the fifteenth order of the predetermined frequency is produced, and wherein each said second section comprises a substantially sheet-like section of low coercive force, high permeability material aligned with and in close proximity to said elongated piece forming a first section so as to be magnetically interconnected therewith when said remanently magnetizable material is not magnetized in said predetermined pattern, the ratio of length to square root of cross sectional area of the magnetically interconnected sections thereupon being less than 150, such that the harmonic response produced when the interconnected sections are in a said field does not result in a characteristic response.

5. A marker according to claim 1, wherein said piece of low coercive force, high permeability material comprises a sheet-like piece of such material, and wherein a sheet-like piece of remanently magnetizable material overlies a portion of the sheet-like piece of low coercive force, high permeability material, whereby magnetization of said remanently magnetizable piece in a said predetermined pattern creates an associated magnetic field which inhibits magnetization reversal of only that portion overlaid by said predetermined pattern leaving a magnetically isolated portion which is free to magnetically reverse and to generate a said characteristic response.

6. A marker according to claim 5, wherein said pieces of low coercive force, high permeability material and remanently magnetizable material comprise sheets of substantially the same size and shape.

7. A marker according to claim 5, wherein said sheet-like piece of remanently magnetizable material overlies only certain portions of said sheet-like piece of high permeability material, the remaining portions including at least one region of reduced cross-sectional area and at least one flux collector on each end of said region of reduced cross-sectional area, which remaining portions are magnetically isolated when the magnetic field associated with a said predetermined pattern magnetized in said magnetizable piece is impressed on said certain portions, thereby enabling said region of reduced cross-sectional area to function as a switching section and to generate a said characteristic response when sufficient flux from a said field is concentrated therein by the flux collectors.

8. A marker according to claim 7, wherein said region of reduced cross-sectional area has a minimum width, the cross-sectional area of which is in the range of 0.003 to 0.03 $mm^2$ and a length not greater than 2.0 cm the terminal ends of which are defined by points at which the width parallel to said minimum width is no lon9er less than five times said minimum width, such that when exposed to a said field alternating at a predetermined frequency, a said characteristic response is produced which contains readily detectable harmonics of said predetermined frequency.

9. A marker according to claim 1, wherein said magnetizable material is provided in two substantially semicircular sheet-like pieces, each piece being adjacent an opposite edge of a rectangular sheet-like piece of the low coercive force, high permeability material, leaving therebetween a narrow portion of the low coercive force, high permeability material which forms said switching section and wider portions forming flux collectors adjacent to where the boundaries of the semicircular pieces diverge from each other.

10. A marker according to claim 7, including at least two regions of reduced cross-sectional area having lengths normal to the minimum widths in said reduced cross-sectional areas extending in substantially different directions and at least one flux collector on each end of each region of reduced cross-sectional area.

11. A marker according to claim 10, wherein said sheet-like piece of low coercive force, high permeability material is substantially square, and said sheet-like piece of remanently magnetizable material is substantially circular and is centered within the square, thereby leaving along each of the four edges regions of reduced cross-sectional area forming four of said switching sections, with flux collectors at all four corners.

12. A marker according to claim 5, wherein said sheet-like piece of low coercive force, high permeability material has at least one hole spaced a distance in the range of 0.125 to 1.25 mm from one edge of the piece to define at least one region of reduced cross-sectional area and has regions of greater cross-sectional area extending away from the region of reduced cross-sectional area, whereby the region of reduced cross-sectional area functions as a switching section and generates a characteristic response when sufficient flux from a said field is concentrated therein by the regions of greater cross-sectional area.

13. A marker according to claim 12, wherein said switching section is defined by a pair of spaced apart holes, the distance therebetween being in the range of 0.125 to 1.25 mm.

14. A marker according to claim 12, wherein the edge of the piece of low coercive force, high permeability material has notches spaced apart from a hole a distance in the range of 0.125 to 1.25 mm to define a said switching section therebetween.

15. A marker according to claim 12, wherein said piece of low coercive force material is a polygon having at least one hole therethrough substantially at the mid point of each side and spaced from the edge thereof to define a switching section along each edge.

16. A marker according to claim 15, wherein said piece of remanently magnetizable material extends over a central region generally defined by said holes.

17. A marker according to claim 15, wherein said piece of remanently magnetizable material extends over substantially the entire piece of low coercive force material.

18. A marker according to claim 1, wherein said piece of remanently magnetizable material comprises a coating of magnetizable particles in an organic binder.

19. A marker according to claim 18, wherein said particles exhibit a preferred direction of magnetization and are substantially oriented in said dispersion such that the preferred directions of magnetization of the particles are parallel.

20. A marker according to claim 1, wherein said remanently magnetizable material is magnetized in a said predetermined pattern.

21. A marker according to claim 1, wherein said pieces of low coercive force, high permeability material and remanently magnetizable material comprise sheets of substantially the same size and shape, and wherein said piece of remanently magnetizable material is magnetized in a said predetermined pattern leaving a remaining unbiased portion of said piece of the low coercive force, high permeability material which includes at least one region of reduced cross-sectional area and at least one flux collector on each end of said reduced cross-sectional area, whereby said reduced cross-sectional area functions as a switching section and generates a said characteristic response when sufficient flux from a said interrogation field is concentrated therein by the flux collectors.

22. A marker according to claim 21, wherein said magnetized predetermined pattern leaves a said remaining unbiased region of reduced cross-sectional area having a minimum width, the cross-sectional area of which is in the range of 0.003 to 0.03 $mm^2$ and a length not greater than 2.0 cm the terminal ends of which are defined by points at which the width parallel to said minimum width is no longer less than five times said minimum width, such that when exposed to a said field, alternating at a predetermined frequency, a said characteristic response is produced which contains readily detectable harmonics of said predetermined frequency.

23. A marker according to claim 21, wherein said magnetized predetermined pattern comprises two substantially semicircular areas, each area being adjacent an opposite edge of a rectangular piece of the low coercive force, high permeability material, leaving unbiased a narrow portion of the low coercive force, high permeability material between the semicircular portions which form a said switching section and wider portions in areas corresponding to the areas where the boundaries of the semicircular patterns diverge from each other which form the flux collectors.

24. A marker according to claim 21, wherein the unbiased portion remaining outside the predetermined pattern comprises a plurality of switching sections and flux collectors extending in at least two significantly different directions.

25. A marker according to claim 24, wherein the piece of low coercive force, high permeability material is substantially square and the area encompassed by the predetermined pattern on the remanently magnetized material is substantially square and is diagonally centered within the square piece of high permeability material, thereby leaving a said switching section between each corner of the diagonally centered pattern and the adjacent edge of the square piece of high permeability material, and flux collectors at all four corners of said square piece of high permeability material.

26. A marker according to claim 25, wherein the sheet-like piece of low coercive force, high permeability material has along each edge thereof a notch spaced apart from a more centrally located hole a distance in the range 0.125 to 1.25 mm to define a said switching section therebetween, and wherein said predetermined magnetized pattern extends over a central region generally defined by said more centrally located holes.

27. A marker according to claim 24, wherein the piece of low coercive force, high permeability material is substantially square and the area encompassed by the predetermined pattern on the remanently magnetized material is substantially circular and is centered within the square, thereby leaving along each of the four edges a said switching section with flux collectors at all four corners.

28. A marker according to claim 27 wherein the sheet-like piece of low coercive force, high permeability material has along each edge thereof a notch spaced apart from a more centrally located hole a distance in the range 0.125 to 1.25 mm to define a said switching section therebetween, and wherein said predetermined magnetized pattern extends over a central region generally defined by said more centrally located holes.

29. A marker according to claim 21, wherein said predetermined magnetization pattern extends over a given area and contains parallel bands of poles of alternate polarity.

30. A marker for use in an electronic article surveillance system having within an interrogation zone an alternating magnetic field, said marker comprising a substantially two dimensional piece of low coercive force, high permeability material the overall dimensions of which are such as to prevent the magnetization in the entire piece from rapidly reversing so as to produce a characteristic response when the marker is exposed to a said alternating field, and at least one piece of remanently magnetized material adjacent at least a portion of the piece of low coercive force material, magnetized in a predetermined pattern to thereby bias only those adjacent portions of said piece of low coercive force material and inhibit the magnetization in those adjacent portions from rapidly reversing when the marker is exposed to a said alternating field such that those portions are magnetically inactive, the dimensions of the remaining, non-biased portions of said piece of low coercive force material being such that a characteristic response will result from rapid magnetization reversal of those remaining portions when the marker is in a said field.

31. A marker according to claim 30, wherein said piece of low coercive force, high permeability material comprises a sheet-like piece of such material, wherein a sheet-like piece of remanently magnetized material overlies a portion of the sheet-like piece of low coercive force, high permeability material, and wherein said premagnetized pattern encompasses only a part of the high permeability piece leaving a magnetically isolated portion in which the magnetization is free to rapidly reverse and to generate a said characteristic response when magnetization reversal of the portion overlaid by the predetermined magnetized pattern is inhibited.

32. An electronic article surveillance system comprising (a) means for generating in an interrogation zone an alternating magnetic field, (b) a marker comprising a substantially two dimensional piece of low coercive force, high permeability material, the overall dimensions of which are such as to prevent the magnetization in the entire piece from rapidly reversing so as to produce a characteristic response when the marker is exposed to a said alternating field, and at least one piece of remanently magnetized material adjacent at least a portion of the piece of low coercive force material, magnetized in a predetermined pattern to thereby bias only those adjacent portions of said piece of low coercive force material, thereby inhibiting the magnetization in those adjacent portions from rapidly reversing when the marker is exposed to a said alternating field such that those portions are magnetically inactive, the dimensions of the remaining, non-biased portions of said piece of low coercive force material being such that a characteristic response may result from rapid magnetization reversal of the remaining portions when the marker is in the said field, (c) means for detecting signals resulting from rapid magnetization reversals of a said marker and for producing an alarm indication upon detecting a characteristic response, and (d) means for impressing on said marker a magnetic field to remove said predetermined magnetized pattern, such that the reversal of the magnetization in all portions of the piece of low coercive force, high permeability material when the marker is exposed to a said alternating field does not result in the production of a said characteristic response.

33. A system according to claim 32, wherein said field generating means comprises means for generating a said field alternating at a predetermined frequency, wherein said marker comprises a sheet-like piece of low coercive force, high permeability material and a sheet-like piece of remanently magnetizable material adjacent to a portion of the first piece, wherein the magnetizable material is magnetized in a said predetermined pattern to inhibit magnetization reversal in those portions of the first piece which are adjacent the magnetized pattern and wherein the remaining unbiased portion of said first piece has an elongated shape in which the ratio of length to square root of cross-sectional area is not less than 150, such that when exposed to a said field alternating at a predetermined frequency, a said characteristic response containing readily detectable harmonics in excess of the fifteenth order of the predetermined frequency is produced, whereas the biased portion has a shape such that when said magnetizable material is not magnetized in said predetermined pattern, the ratio of length to square root of cross-sectional area of the entire piece of low coercive force material is less than 150 and the harmonic response produced upon magnetization reversal of the entire piece when in a said field is significantly altered and no characteristic response therefore produced, and wherein said detecting means includes means responsive to said detectable harmonics for producing a said alarm.

34. A system according to claim 32, wherein said predetermined magnetized pattern is such as to leave a remaining unbiased portion of said piece of the low coercive force, high permeability material which includes at least one region of reduced cross-sectional area which functions as a switching section when sufficient flux from a said field is concentrated therein to generate a said characteristic response and at least one flux collector on opposite ends of said reduced cross-sectional area for collecting flux from said field and concentrating the same within said area.

35. A system according to claim 34, wherein said field generating means comprises means for generating a said field alternating at a predetermined frequency, wherein said region of reduced cross-sectional area of the marker has a minimum width, the cross-sectional area which is in the range of 0.003 to 0.03 $mm^2$ and a length which is not greater than 2.0 cm, the terminal ends being defined by points at which the width parallel to said minimum width is no longer less than five times said minimum width such that readily detectable harmonics of said predetermined frequency are produced upon exposure to a said field, and wherein said detecting means includes means responsive to said detectable harmonics for producing a said alarm.

36. A method of making a marker for use in an electronic article surveillance system having within an interrogaton zone an alternating field, said method comprising (a) providing at least one substantially two dimensional piece of low coercive force, high permeability material having overall dimensions such as to prevent the production of a characteristic response when the marker is exposed to a said alternating field, (b) providing at least one piece of remanently magnetizable material adjacent at least a portion of the piece of low coercive force material, and (c) magnetizing portions of said remanently magnetizable material in a predetermined pattern to thereby bias only those portions of said piece of low coercive force material which are adjacent to the magnetized portions, thereby inhibiting magnetic flux changes in those adjacent portions the dimensions of the remaining non-biased portions of said piece of low coercive force material being such that a characteristic response will result when the marker is in a said field.

37. A method according to claim 36, wherein said step of magnetizing comprises exposing said remanently magnetizable material to a repetitive, alternating polarity field pattern extending over an area corresponding to said predetermined pattern.

38. A method according to claim 37, wherein said magnetizing step comprises exposing said remanently magnetizable material to the external field of a permanent magnet assembly shaped to provide a said external field corresponding to a said predetermined pattern which extends over a given area, said assembly exhibiting parallel bands of opposite magnetization, the intensity of each band extending uniformly from one edge to an opposite edge of said area, and wherein the width of each band is between 1 and 6 mm.

39. A method according to claim 37, wherein said magnetizing step comprises exposing said remanently magnetizable material to an external field shaped to provide a said predetermined pattern which extends over a given area and which contains a checkerboard of alternate polarities extending in generally orthogonal directions.

40. A method according to claim 39, wherein each region of alternate polarities is in the range between 1 and 6 mm wide in each orthogonal direction.

41. A method of controlling the state of a dual status marker in an electronic article surveillance system having within an interrogation zone an alternating field, wherein the marker comprises at least one substantially two dimensional piece of low coercive force, high permeability material having overall dimensions such as to prevent the production of a characteristic response when the marker is exposed to a said alternating field and at least one piece of remanently magnetizable material adjacent at least a substantial portion of the piece of low coercive force material, wherein said method comprises the step of magnetizing at least portions of said magnetizable material in a predetermined pattern to thereby bias only those portions of said piece of low coercive force material which are adjacent to the magnetized portions, thereby inhibiting magnetic flux changes in those adjacent portions when the marker is exposed to a said alternating field, the dimensions of the remaining, non-biased portions of said piece of low coercive force material being such that a characteristic response will result when the marker is in a said field, such that the marker is in a sensitized state.

42. A method according to claim 41, further comprising the step of exposing said marker to a magnetic field to remove said predetermined magnetized pattern, thereby desensitizing the marker such that when a thus densensitized marker is in a said alternating field within a said interrogation zone, the magnetization of all portions of said piece of low coercive force, high permeability material will reverse and no characteristic response will thereby be produced.

* * * * *